United States Patent [19]

Hill

[11] 4,046,314

[45] Sept. 6, 1977

[54] HANDLES FOR CARDBOARD OR CORRUGATED PAPER BOXES

[76] Inventor: William L. Hill, 1219 Seventh St., San Fernando, Calif. 91340

[21] Appl. No.: 663,114

[22] Filed: Mar. 2, 1976

[51] Int. Cl.[2] ..... B65D 5/46; B65D 25/22

[52] U.S. Cl. ..... 229/52 AW

[58] Field of Search ..... 229/52 AW

[56] References Cited

U.S. PATENT DOCUMENTS

| | | | |
|---|---|---|---|
| 934,485 | 9/1909 | Wagner | 229/52 AW |
| 1,931,329 | 10/1933 | Sherman | 229/52 AW |
| 2,066,258 | 12/1936 | Evans | 229/52 AW |
| 2,195,070 | 3/1940 | Backert | 229/52 AW |
| 2,944,722 | 7/1960 | Dahlhauser et al. | 229/52 AW X |
| 3,001,688 | 9/1961 | Hokenson | 229/52 AW |
| 3,112,059 | 11/1963 | Laver | 229/52 AW |

*Primary Examiner*—Davis T. Moorhead
*Attorney, Agent, or Firm*—Robert C. Smith

[57] ABSTRACT

A simple and inexpensive handle for cardboard or corrugated paper boxes consists of a generally U-shaped wire member having a straight center hand-hold section and a pair of leg sections each of which is bent at approximately right angles from the direction of the center section. Each leg section includes, preferably, a point at its end terminating a short offset portion provided to penetrate the side of the box, a straight section to be held flat against the outside end wall of the box, a short, small-diameter U-shaped bend for passing through the side of the box, and a second essentially straight section preferably formed at a slight angle with respect to the first straight section to cause the hand-hold to stand a slight distance away from the side of the box. A latch pin, preferably consisting of a length of wire somewhat longer than said center section, is inserted through the portions of the small U-shaped bends extending into the inside of the box, thereby securely holding the handle to the box while permitting its easy removal.

2 Claims, 4 Drawing Figures

HANDLES FOR CARDBOARD OR CORRUGATED PAPER BOXES

BACKGROUND OF THE INVENTION

There are many commodities which are shipped in cardboard or corrugated paper boxes having considerable strength and which are designed to hold contents of appreciable weight. Frequently it is necessary or desirable to carry the shipping box from place to place with all or part of the contents therein rather than to transfer the contents to some sort of carrying tray or cart. Carrying such boxes is frequently difficult whether the box is closed or opened. It becomes somewhat more awkward to carry when the top of the box and some of the contents have been removed, since the box then tends to lose much of the stiffness provided by the top and the full load of contents. It would therefore be desirable to have carrying handles built into such boxes.

One type of handle which has been used consists simply of a partial cut-out on each end of the box with a flap folded upwardly on the inside of the box to provide a hand-hold. This may be satisfactory where the contents are not too heavy and do not occupy such space as is required for the fingers to be inserted. Where metal or plastic wrapping straps are used to secure the box for shipping, such straps sometimes incorporate handles or have handles associated with the straps. Such handles remain useful only so long as the straps are not cut. Other types of conventional handles are occasionally employed where costs will permit, but such handles are not normally readily transferable to another box or carton. There is, therefore, a need for a simple and inexpensive carrying handle which can be either incorporated into a shipping box so that it can be used both in handling unopened boxes and opened, partially-filled boxes, or which can be easily attached to opened boxes to make carrying such boxes much easier.

DESCRIPTION OF THE PREFERRED EMBODIMENT

Figure 1:
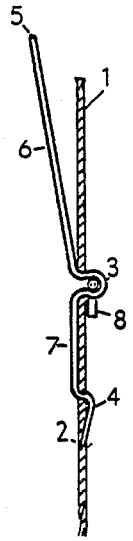
FIG. 1 is a fragmentary side view, partially in section, of a carrying handle according to my invention as installed on the side of a box.

FIG. 1 is a fragmentary side view, partially in section, of the end of a cardboard or paper box 1 having attached thereto a handle according to my invention. The handle is preferably a U-shaped piece of wire wherein the ends 2 are preferably sharpened and placed on an offset portion 4 such that they penetrate the side of box 1 and then are curved back to penetrate again at the points. A straight section 7 is interrupted by a small-radius U-shaped bend portion on each of the lengths 6 which extend downwardly from a laterally extending hand-hold portion 5. The small-radius U-shaped bend portion 3 extends through the side of box 1 into its inside and forms a loop of sufficient size to receive a cross pin 8.

Figure 2:
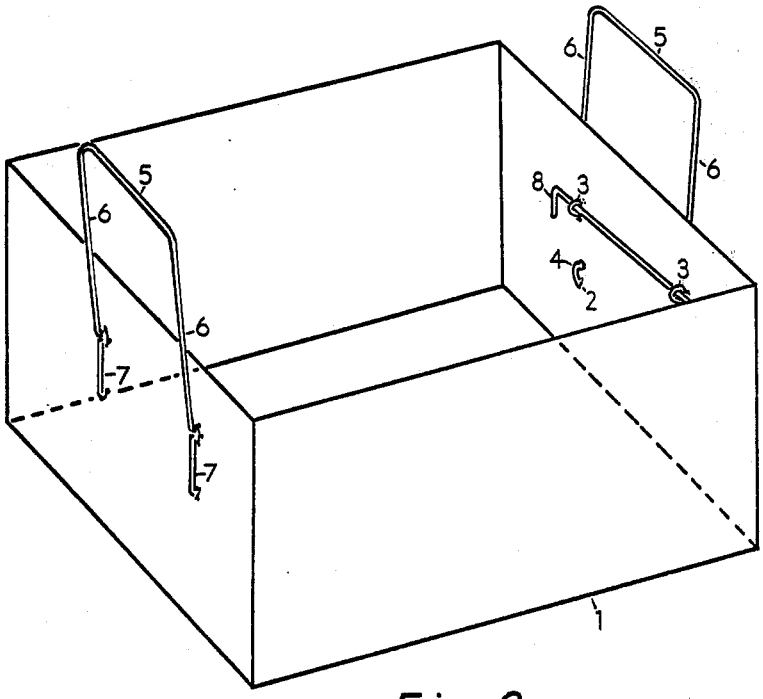
FIG. 2 is an orthogonal projection of a cardboard box having handles installed according to my invention.

The interrelationships of the various parts of the handles may be more clearly understood from consideration of FIG. 2 which is an orthogonal projection of a typical cardboard or corrugated paper box showing my handles installed thereon. Here it will be observed that the box 1 has my wire handle members installed at each end, each of the handles consisting of a laterally extending portion 5 with legs 6 extending downwardly therefrom. In this view, it is easily seen how the U-shaped bends 3 in the downwardly extending legs 6 protrude through the side of the box such that the locking pin 8 extends through each of the bend portions 3 to lock the handle to the side of the box. In this view it will also be seen that the points 2 of the downwardly extending portions 6 also punch through the side of the box as shown at 4, and points 2 also punch through slightly to anchor the handle.

Figure 4:
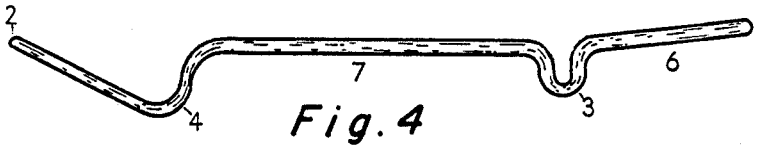
FIG. 4 is a side view of the handle shown in FIG. 3.
Figure 3:
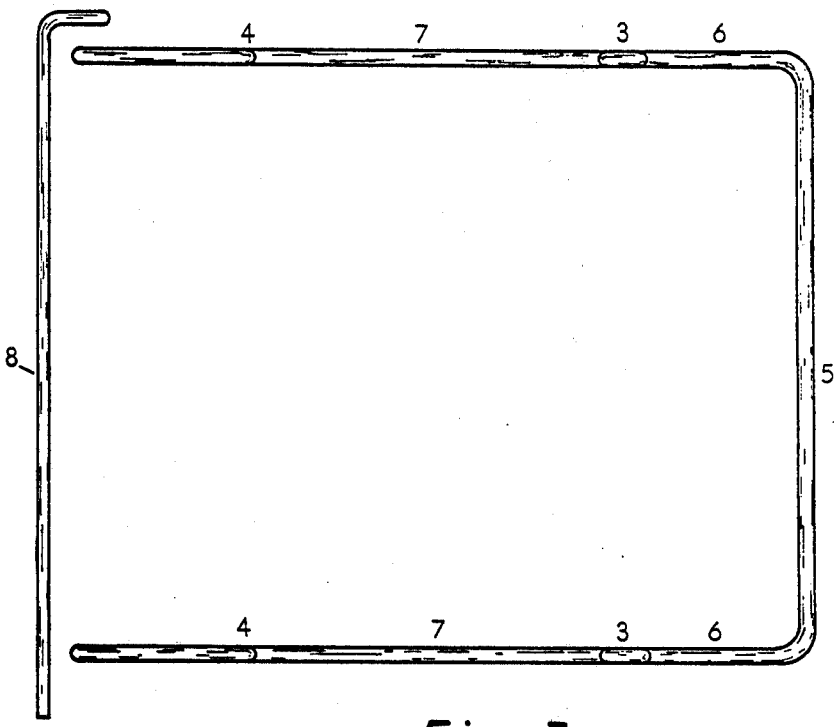
FIG. 3 is a plan view of the handle shown in FIGS. 1 and 2.

A plan view of the handle structure shown in FIGS. 1 and 2 appears in FIG. 3. In this case the laterally extending portion 5 and the downwardly depending legs 6 appear as an essentially U-shaped wire member, and if this view is also compared with the side view of FIG. 4 it will be seen that the straight section 7 of the leg is preferably at a slight angle from the upper portion of leg 6 such that the hand-engaging portion of the handle will stand away from the side of the box to a degree. Similarly the offset portion 4 which penetrates the side of the box is shown. The end portion 2 may be made in a sharpened or chisel configuation as desired. The locking pin 8 is also shown in FIG. 3 and consists essentially in an elongated wire member of length slightly exceeding the length of section 5 of the handle with a short 90° bend at one end thereof. The depth of the small-radius bends 3 should be chosen such that they protrude through the side of the box 1 just a sufficient distance that the latching pin 8 can be received between the loop and the side of box 1.

While my invention is shown here in connection with a box from which the top has been removed, it is apparent that the top could be placed on the box 1 and the handles will operate just the same. Should the top be of sufficient depth that the protruding bends 3 cause interference, a number of choices can be employed for dealing with this problem. It may be desired that the depth of bends 3 be increased sufficiently that these bends can penetrate the layers of both the bottom and the top, particularly where the sides may be open to enable the latch pin 8 to be inserted. Alternatively, the top may be slotted so that it may be placed down over the part of box 1, thereby sliding over the bends 3. With the arrangement shown, it is apparent that the latch pin 3 may be easily removed, permitting removal of the handles such that they may easily be attached to another box or carton as desired. Where the latch pin 8 is not held tightly between the bends 3 and the side of box 1, a second short bend section may be included at the opposite end from the first one to prevent its jiggling loose. Although the handles are designed to be forcibly punched through the end panels of box 1, it is apparent that these panels may be perforated to receive the handles, if desired. These handles, once installed, distribute the load such that they have great resistance to tearing out, even with quite heavy loads in the carton.

Modifications will occur to those skilled in the art. While the use of the small loops as shown at 3 and the simple wire latch pin 8 would appear to be the simplest and least expensive way of accomplishing this function, the configuration of loop 3 can obviously be varied somewhat to accommodate a latch member of somewhat different cross-section. Where loads are not too heavy, it is sometimes possible to dispense with the latch pin altogether, as when it is desired to move many boxes and only a single set of handles is available to be rapidly transferred from box to box. This would only be a temporary expedient, however, since the handles are then free to fall from the sides of the box.

I claim:

1. A pair of carrying handles for attachment to opposite sides of cardboard boxes and the like each of which comprises a first wire member having a generally U-shaped configuration with an essentially straight center section as a hand-contacting member and a pair of leg sections extending at approximately right angles from said center section for attachment to an associated box, said leg sections being of essentially identical configuration and each including a first straight section adjacent said center section, a small-radius U-shaped bend portion therealong at the oposite end of said first straight section, a second straight section continuing from the opposite side of said U-shaped bend portion at a slight angle with respect to said first straight section, and an offset portion just short of the end of said leg section terminating in an additional generally downwardly extending straight section at an angle with respect to said second straight section, said leg sections having sharp ends such that, under load, they tend to penetrate the inside surface of the box;

and second elongated members each of which comprises an essentially straight wire member of greater length than the length of the center section of said handle;

the ends of each of said leg sections and said U-shaped bend portions being insertable through the side of said box, and said second elongated members being insertable through said U-shaped bend portions on the inside of said box to secure said handle to said box, said U-shaped bend portion extending essentially perpendicularly from said straight sections at a distance only slightly greater than the thickness of said associated box such that said second elongated member may be secured tightly between the inside surface of said bend portions and the inside surface of said associated box.

2. A carrying handle as set forth in claim 1 wherein said second straight wire member includes a short bent section at one end.

* * * * *